US007172053B2

(12) United States Patent
Slavich

(10) Patent No.: US 7,172,053 B2
(45) Date of Patent: Feb. 6, 2007

(54) KNOCKDOWN SAWHORSE

(76) Inventor: Stefano Slavich, 656, Chabanel, Chicoutimi, Quebec (CA) G7H 3S7

( * ) Notice: Subject to any disclaimer, the term of this patent is extended or adjusted under 35 U.S.C. 154(b) by 155 days.

(21) Appl. No.: 11/076,557

(22) Filed: Mar. 8, 2005

(65) Prior Publication Data

US 2005/0199443 A1 Sep. 15, 2005

(30) Foreign Application Priority Data

Mar. 9, 2004 (CA) ..... 2460472

(51) Int. Cl.
*E04G 1/34* (2006.01)
*E04G 1/32* (2006.01)

(52) U.S. Cl. ..... 182/153; 182/22.5

(58) Field of Classification Search ..... 182/153, 182/151, 181.1, 225, 224, 182.4, 155, 186.5, 182/186.2, 186.1
See application file for complete search history.

(56) References Cited

U.S. PATENT DOCUMENTS 2,412,716 A * 12/1946 Campbell ..... 182/129
3,008,535 A * 11/1961 De Vries ..... 182/186.4
3,058,542 A * 10/1962 Rogalla ..... 182/45
3,110,360 A * 11/1963 Hearn ..... 182/155
3,167,290 A * 1/1965 Beckwell ..... 182/181.1
3,633,709 A * 1/1972 Weser ..... 182/155
3,637,045 A * 1/1972 Poffenbaugh et al. ..... 182/155
3,817,349 A * 6/1974 Barthel ..... 182/155
4,030,565 A * 6/1977 Chaput ..... 182/151
4,296,834 A * 10/1981 Kroger ..... 182/155
4,319,663 A * 3/1982 Barden ..... 182/154
4,403,678 A * 9/1983 Zieg ..... 182/153
4,489,808 A * 12/1984 Voye ..... 182/155
4,711,319 A * 12/1987 Sansotta et al. ..... 182/155
4,754,844 A * 7/1988 Sutton ..... 182/155
4,771,863 A * 9/1988 Stansberry ..... 182/155
4,782,917 A * 11/1988 Schulz ..... 182/182.2
4,926,966 A * 5/1990 Boudreau ..... 182/155
5,704,450 A * 1/1998 Lunceford ..... 182/153
5,878,839 A * 3/1999 Lin ..... 182/181.1
6,092,627 A * 7/2000 Burger ..... 182/186.5
6,129,180 A * 10/2000 Brady ..... 182/186.4
6,564,903 B2 * 5/2003 Krajec ..... 182/153
6,830,129 B1 * 12/2004 Rose ..... 182/129

* cited by examiner

*Primary Examiner*—Hugh B. Thompson, II
(74) *Attorney, Agent, or Firm*—Eric Fincham

(57) ABSTRACT

A portable sawhorse which comprises first and second beam sections which are pivotally connected together to form a storage housing, first and second leg assemblies at respective distal ends of said first and second beam sections, said first and second leg assemblies being pivotally connected so as to be storable within said beam sections, and reinforcing members extending between first and second leg assemblies to stabilize the same when in an opened condition.

10 Claims, 9 Drawing Sheets

KNOCKDOWN SAWHORSE

FIELD OF THE INVENTION

The present invention relates to sawhorses and more particularly, relates to a sawhorse which can be knocked down and wherein a portion of the sawhorse forms a storage case for the remaining components to render the sawhorse portable.

BACKGROUND OF THE INVENTION

Sawhorses are well known in the art and a basic model of the same includes a pair of legs at each end of a beam or support member. The beam or support member provides the working surface. One of the more common uses of sawhorses is to support building materials during construction. Thus, the building material can be placed on the beams or support members of a pair of sawhorses which are spaced apart with the two support members or beams being parallel. The work material is placed on top of the beams or support members thus allowing the user ready access to the building material for cutting, planing, painting, etc.

As aforementioned, the basic sawhorse has been known in the art for many years and generally comprises a wood structure. A disadvantage of such a traditional sawhorse is that it is bulky and therefore requires significant space for storage and transport. Furthermore, they are somewhat awkward to handle.

The prior art has taught the use of various types of collapsible or foldable sawhorses. However, they frequently require significant time to set up and are relatively expensive.

SUMMARY OF THE INVENTION

It is an object of the present invention to provide a sawhorse wherein the sawhorse is collapsible and occupies a minimum amount of space.

It is a further object of the present invention to provide a collapsible sawhorse which is sturdy and can be readily transported.

According to one aspect of the present invention, there is provided a portable sawhorse comprising a first beam section and a second beam section, the first and second beam sections being pivotally connected together, a first leg assembly at a distal end of the first beam section and a second leg assembly at a distal end of the second beam section, each of the first and second leg assemblies having first and second legs extending downwardly, the first and second legs being pivotally connected, reinforcing means extending between the first and second leg assemblies to stabilize the leg assemblies when in an open position.

The beam sections preferably are substantially identical and of an equal size. Each beam section will have a top wall and a pair of sidewalls to form a generally U-shaped configuration. It is between the sidewalls of the beam sections that the remaining components of the sawhorse are stored when the sawhorse is in a collapsed position. To this end, the beam sections are preferably hinged together and there is provided means for securing the beam sections together when in a knocked down condition. Conveniently, a handle may be provided at one end of one of the beam sections or alternatively, along a sidewall thereof.

Preferably, the sawhorse of the present invention is formed of a suitable metallic material, many of which are well known in the art including aluminum, alloys thereof, steel, alloys thereof, etc. Naturally, certain plastic materials can also be utilized. The leg assemblies preferably each comprise first and second legs. Each of the legs preferably has a telescopic arrangement such that they are adjustable in length with suitable means for retaining the leg sections in a desired position. The use of telescopic legs allows the easy storage of the same.

The arrangement of each leg is such that it is hinged at its securement point both that the leg may extend outwardly in a triangular configuration as is well known in the art and also to fold within the respective beam section.

When in an assembled condition, means for retaining the legs in a stable condition are provided and this may conveniently comprise a hinge member extending between the legs.

For additional stability, there is also preferably provided a lower reinforcing assembly extending between the legs/hinges.

The sawhorse also conveniently includes further reinforcing means which may comprise either cables or solid members extending between a lower central point and the ends of the beam sections and leg assemblies. To this end, preferably there is provided a downwardly extending central post which, at its lower end, will allow for attachment of the reinforcing means. As aforementioned, either solid telescopic/hinged arrangements may be used or flexible cables. In the instance of flexible cables, a preferred arrangement includes the use of tensioning means for maintaining the cables in a taut condition. Such tensioning means can include spring or elastic members or an equivalent structure.

BRIEF DESCRIPTION OF THE DRAWINGS

Having thus generally described the invention, reference will be made to the accompanying illustrations, showing an embodiment of the invention, in which.

DESCRIPTION OF THE PREFERRED EMBODIMENTS

Figure 1:
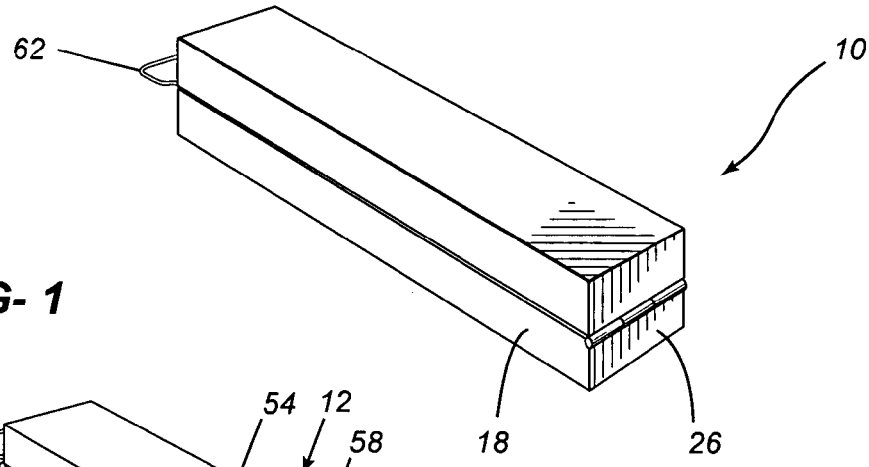
FIG. 1 is a perspective view of a sawhorse according to the present invention when in a collapsed and storage position.
Figure 2:
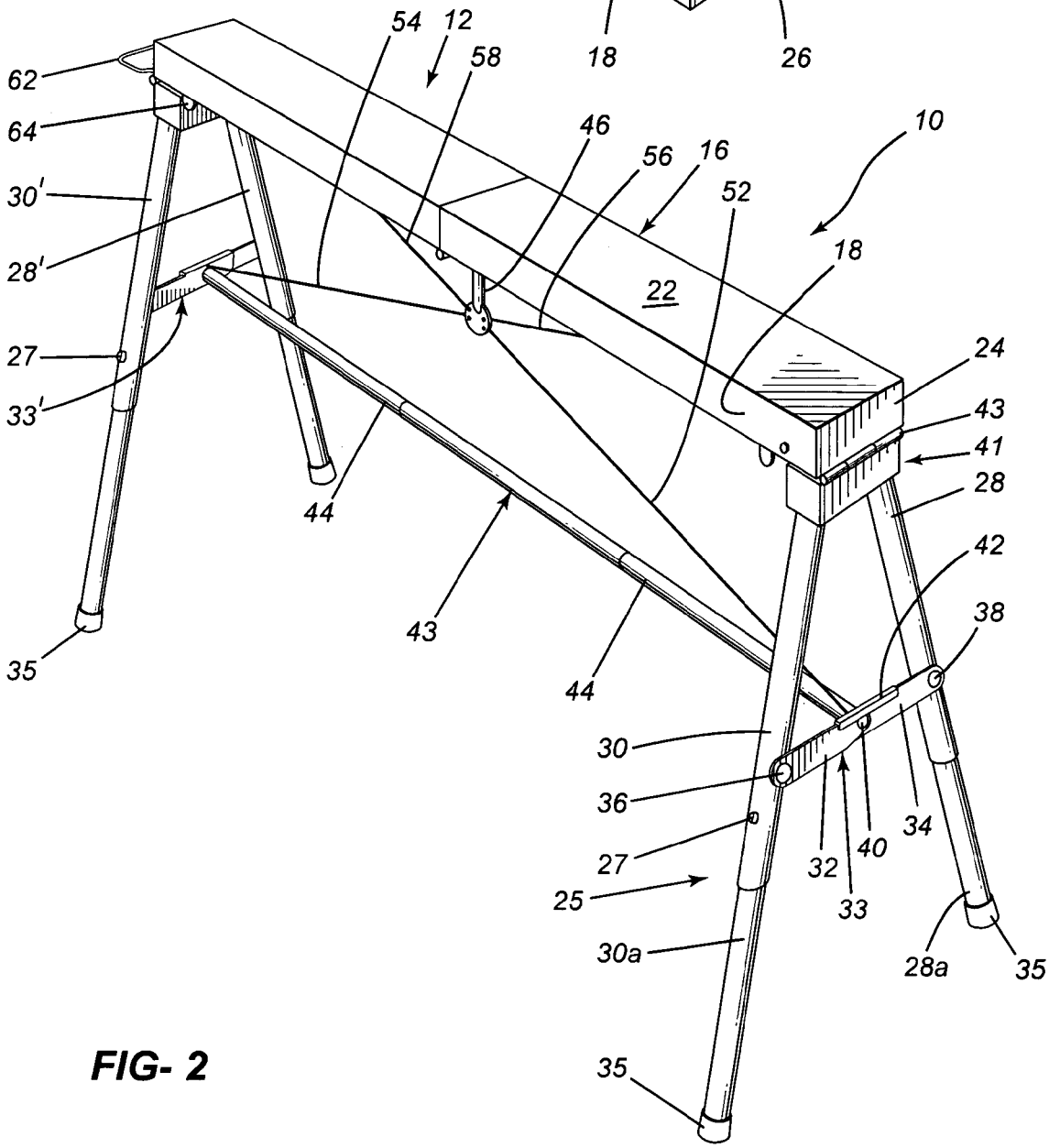
FIG. 2 is a perspective view of the assembled sawhorse.

Referring to the drawings in a greater detail and by reference characters thereto, there is illustrated in FIG. 2 a fully assembled sawhorse according to one embodiment of the present invention and which sawhorse is generally designated by reference numeral 10.

Sawhorse 10 includes a beam which consists of two half members—a right half 16 and a left half 12. As each half beam 16, 12 is substantially identical and forms a single beam when assembled, only one will be described in detail herein. Half beam 16 is formed in a generally U-shaped configuration and has a first sidewall 18, a second sidewall 20, and a top wall 22. Provided at each end are end caps 24, 26. Half beams 16, 21 are connected by a hinge 19.

A pair of leg assemblies are provided with only one such assembly being described herein. The second leg assembly is substantially identical and reference numerals with a prime are utilized for similar components. A first leg assembly generally designated by reference numeral 25 comprises first and second legs 28 and 30, each having a leg extension 28*a*, 30*a* respectively. A retaining pin 27 is provided for securing the leg extensions 28*a*, 30*a* in position as is well known in the art. Rubber end caps 35 are provided on leg extensions 28*a*, 30*a*. A hinge member 33 extends between legs 28, 30 and which hinge member, comprises a first hinge element 32 and a second hinge element 34. First hinge element 32 is connected at pivot point 36 to leg 30 while second hinge element 34 is connected at pivot point 38 to leg 28. First hinge element 32 and second hinge element 34 are connected together at a pivot point 40.

At the upper end, legs 28, 30 are mounted within a leg mounting member 41 and are pivotable therein. In turn, leg mounting assembly 41 is hingedly connected by means of hinge 43 to beam right half 16 to allow storage of assembly 41 and legs 28, 30.

A lower reinforcing assembly 43 extends between hinges 32, 34 and 32', 34'. Lower reinforcing bar 43 may be telescopic in nature or alternatively, as shown may consist of a plurality of sections 44 joined together.

As may be seen in a FIG. 2, there is provided a center post 46 located at the point of a juncture of right half 16 and left half 12. A plate 48 forms a part of center post 46 and to which plate there is secured a plurality of cables.

Plate 48 is screw threadably engaged with center post 46 and thus the position of plate can be changed. Also, post 46 is hingedly connected at its base and thus can be folded over into either right half 16 or left half 12.

A first cable 52 extends between the plate 48 and hinge assembly 32, 34 with a second cable extending between plate 48 and hinge assembly 32', 34'. An upper cable 56 extends between plate 48 and the distal end of beam right half 16. In one embodiment of the invention, a further cable may be provided and which cable (not shown) would extend between plate 48 and lower right reinforcing bar 44 or alternatively, between plate 48 and the floor or substrate on which the sawhorse is placed.

A second upper cable 58 extends between plate 48 and the distal end of beam left half 12. Naturally, some of the individual cables could be combined as a single cable.

For ease of carrying, a handle 62 is provided at one end thereof. A guide member 64 is provided for guiding beam left half 12 and beam right half 16 together when placing the sawhorse in knocked down storage configuration. A locking member or arrangement (not shown) may be provided for securing the half beams together.

Figure 3:
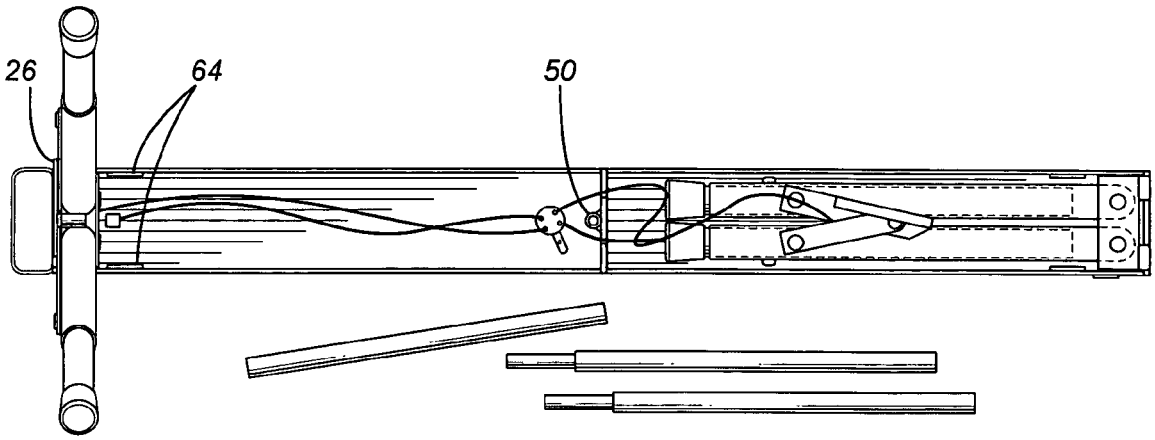
FIG. 3 is a bottom plan view of a partially assembled sawhorse.
Figure 4:
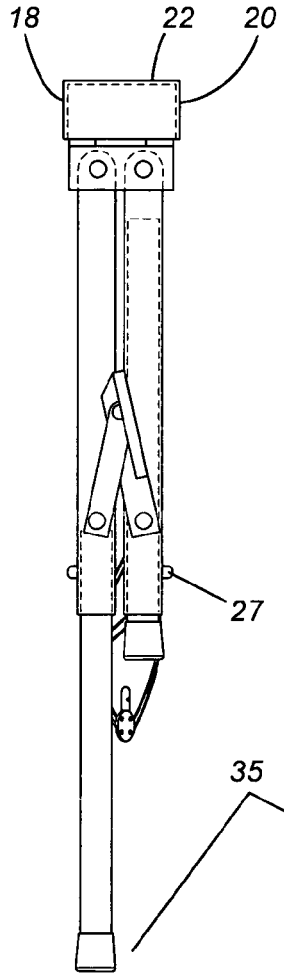
FIG. 4 is an end elevational view thereof in a partially collapsed position.
Figure 5:
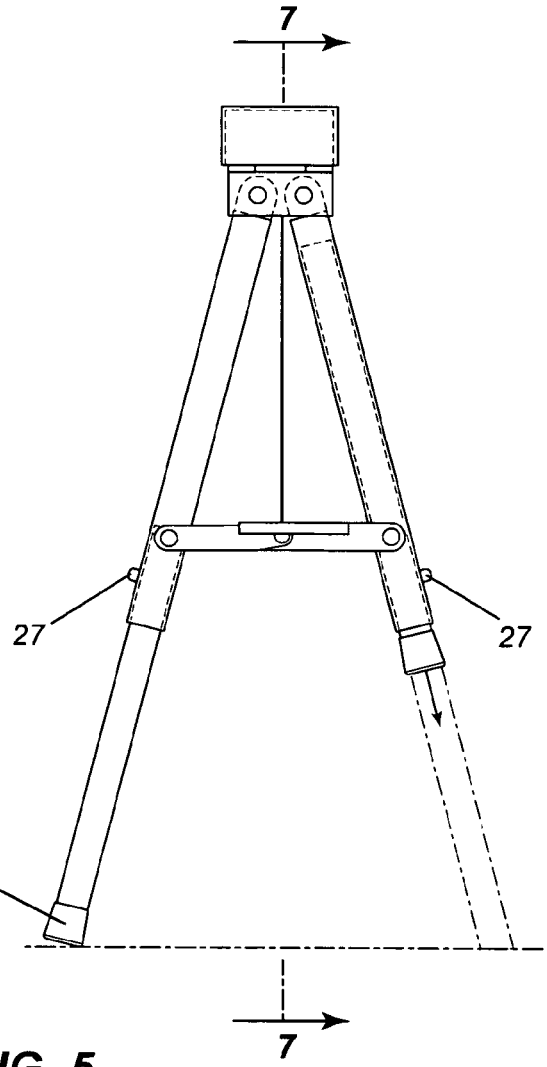
FIG. 5 is an end elevational view of the sawhorse in the assembled condition.
Figure 6:
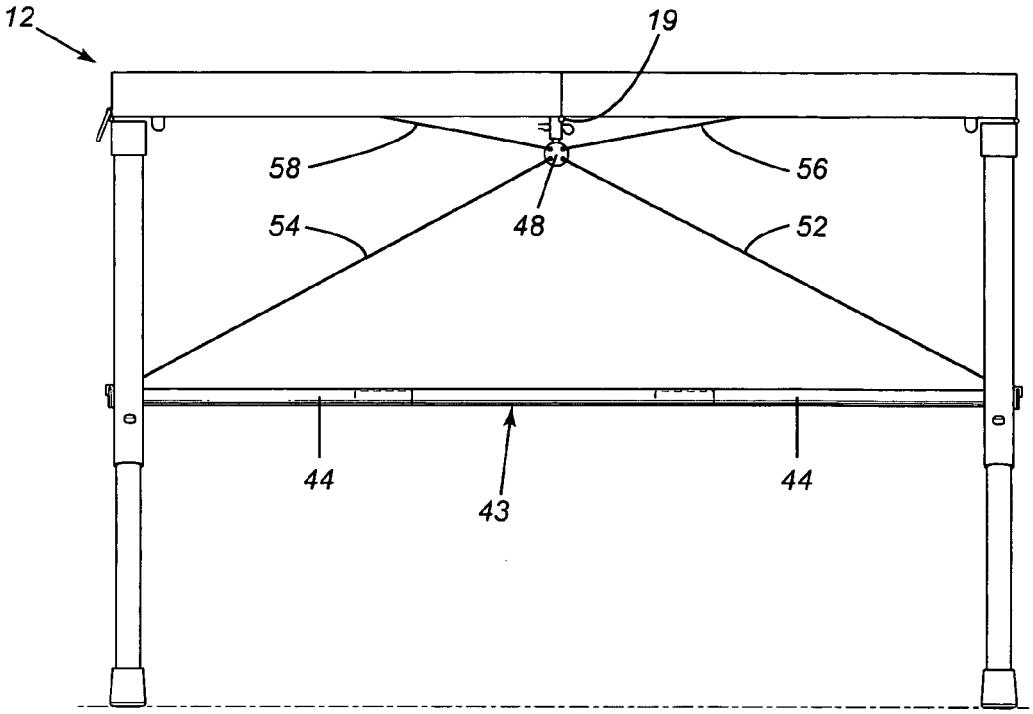
FIG. 6 is a side elevational view thereof.
Figure 7:
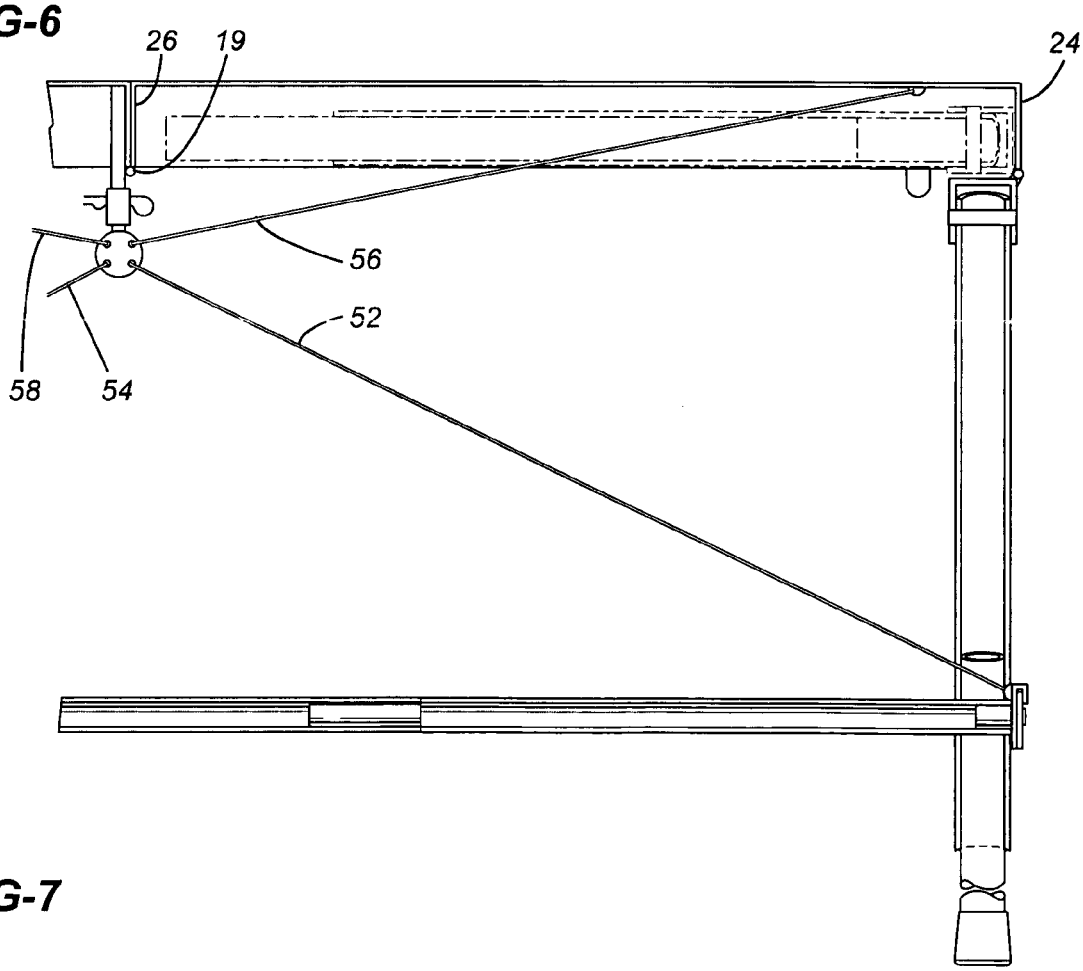
FIG. 7 is a side elevational view of a portion of the assembled sawhorse taken along the lines 7—7 of FIG. 5.
Figure 8:
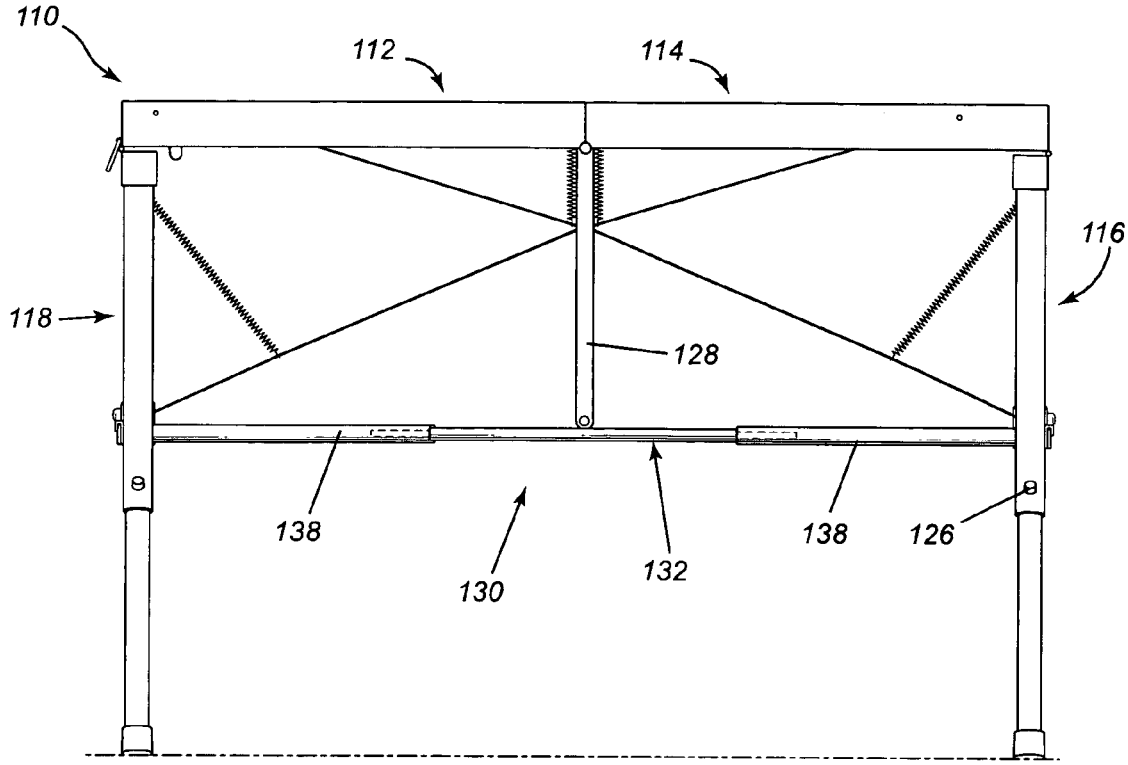
FIG. 8 is a side elevational view of a further embodiment of a sawhorse according to the present invention.

As may be seen in FIGS. 3 and 7, the components fold inwardly to be stored within each of the half beams. The half beams 12, 16 can then be folded together and secured.

The above arrangement provides an extremely compact package and two of the sawhorses can be stored in a standard tool box.

Referring now to FIGS. 8 to 12, there is illustrated a further embodiment of a sawhorse according to the present invention and which sawhorse is generally designated by reference numeral 110.

Sawhorse 110, as in the previously described embodiment, includes a left hand beam 112 and a right hand beam 114. There is also provided a first leg assembly generally designated by reference numeral 116 and a second leg assembly generally designated by reference numeral 118. Since the sawhorse is substantially symmetrical about a center line, only one portion will be described in detail herein.

Figure 9:
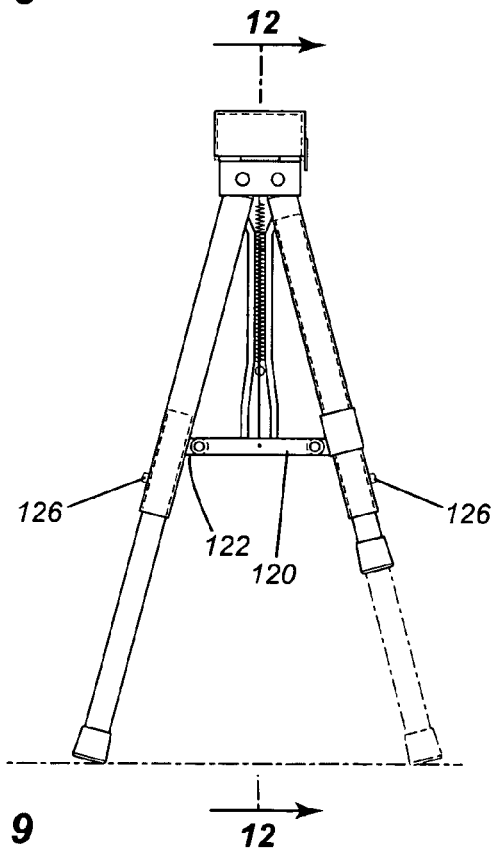
FIG. 9 is an end elevational view thereof.
Figure 10:
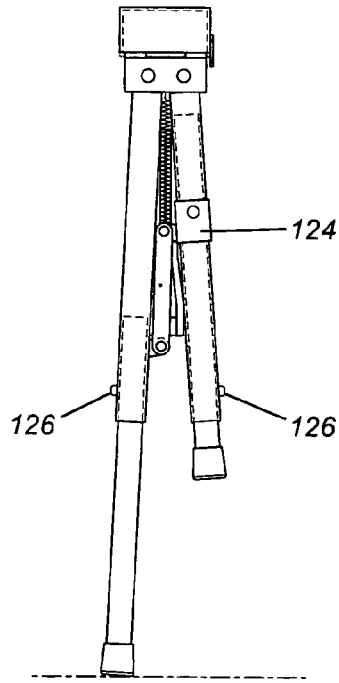
FIG. 10 is an end elevational view thereof in a partially assembled condition.
Figure 11:
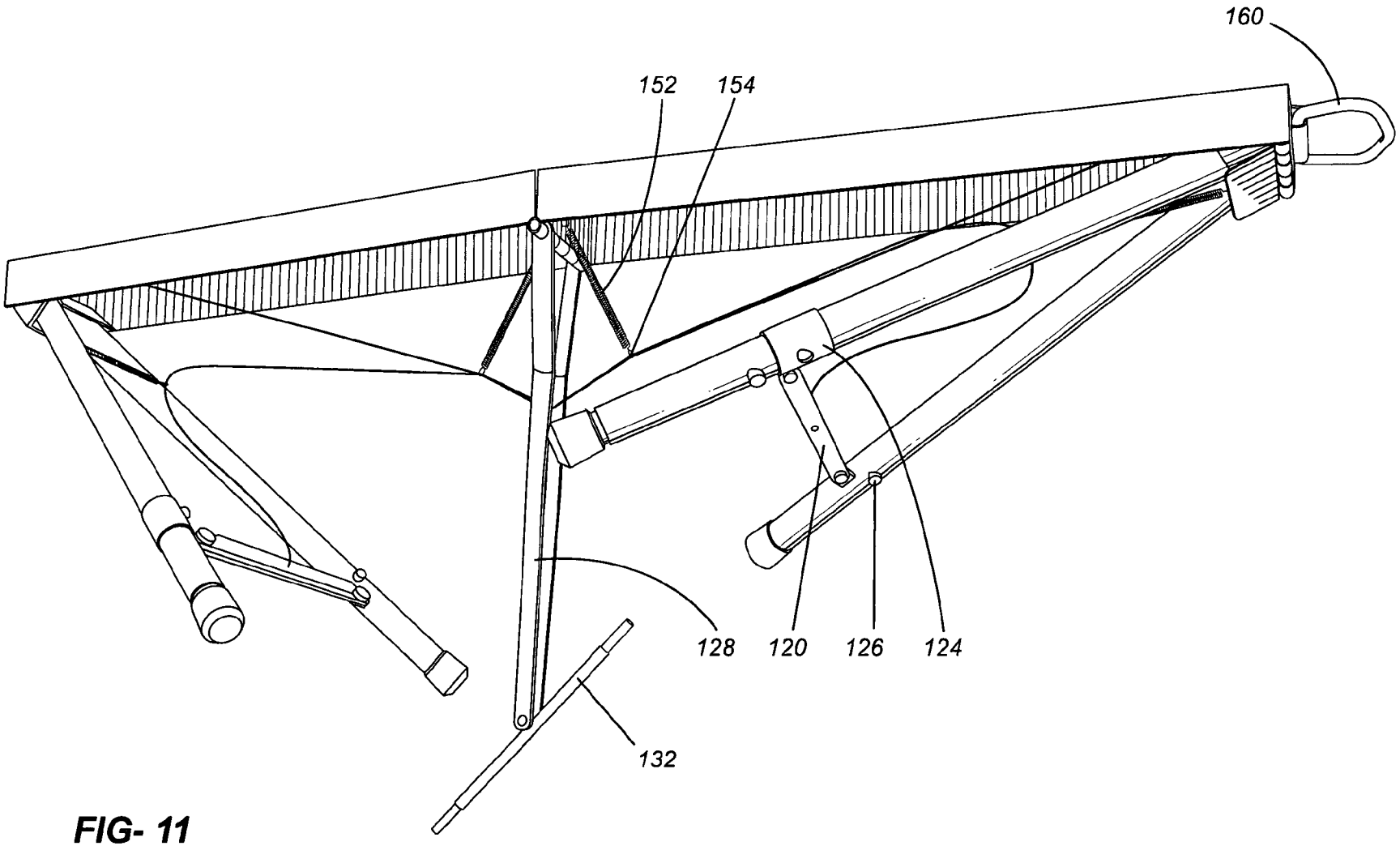
FIG. 11 is a perspective view of the sawhorse in a partially collapsed condition.
Figure 12:
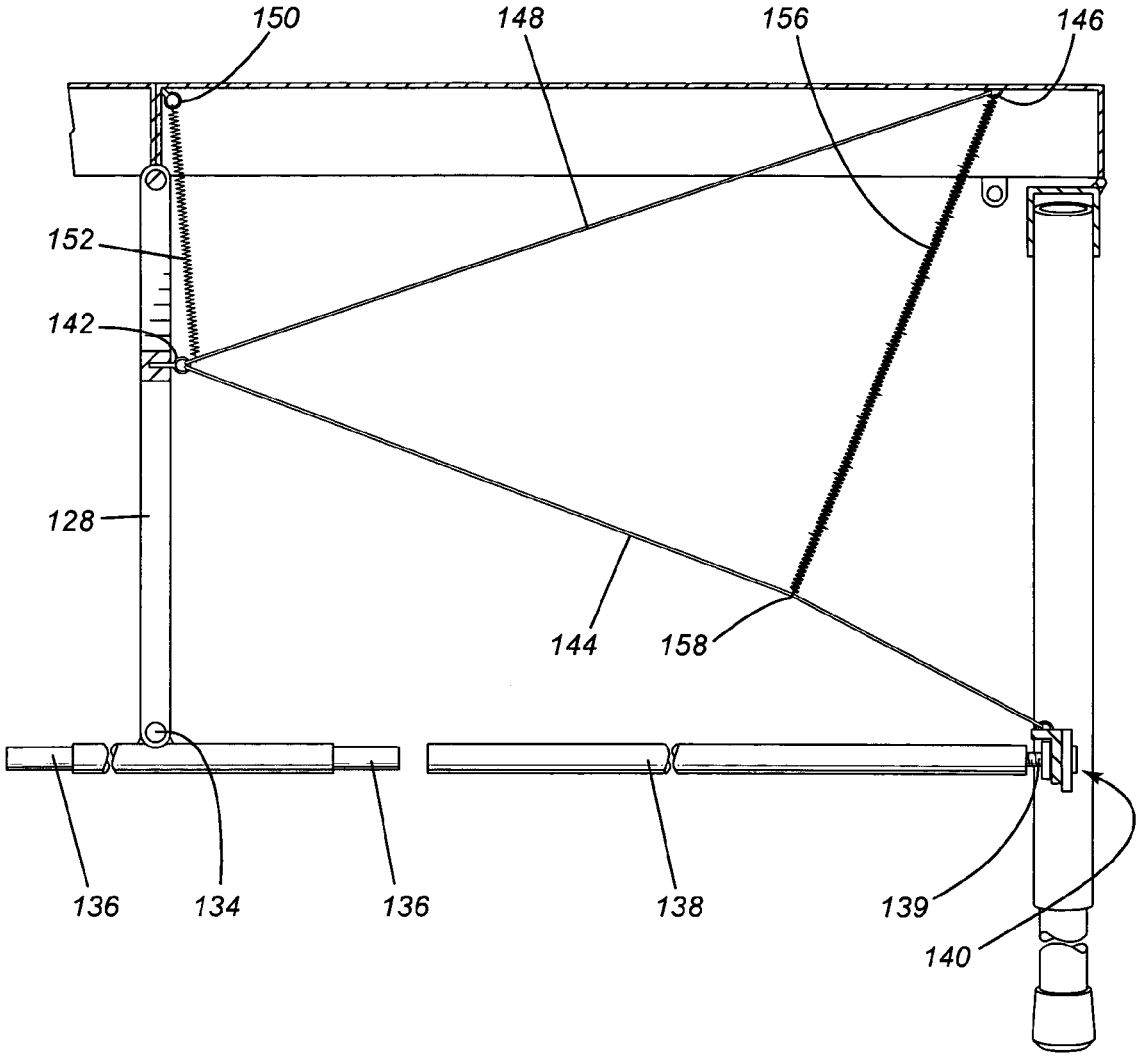
FIG. 12 is a sectional view taken along the lines 12—12 of FIG. 9.
Figure 13:
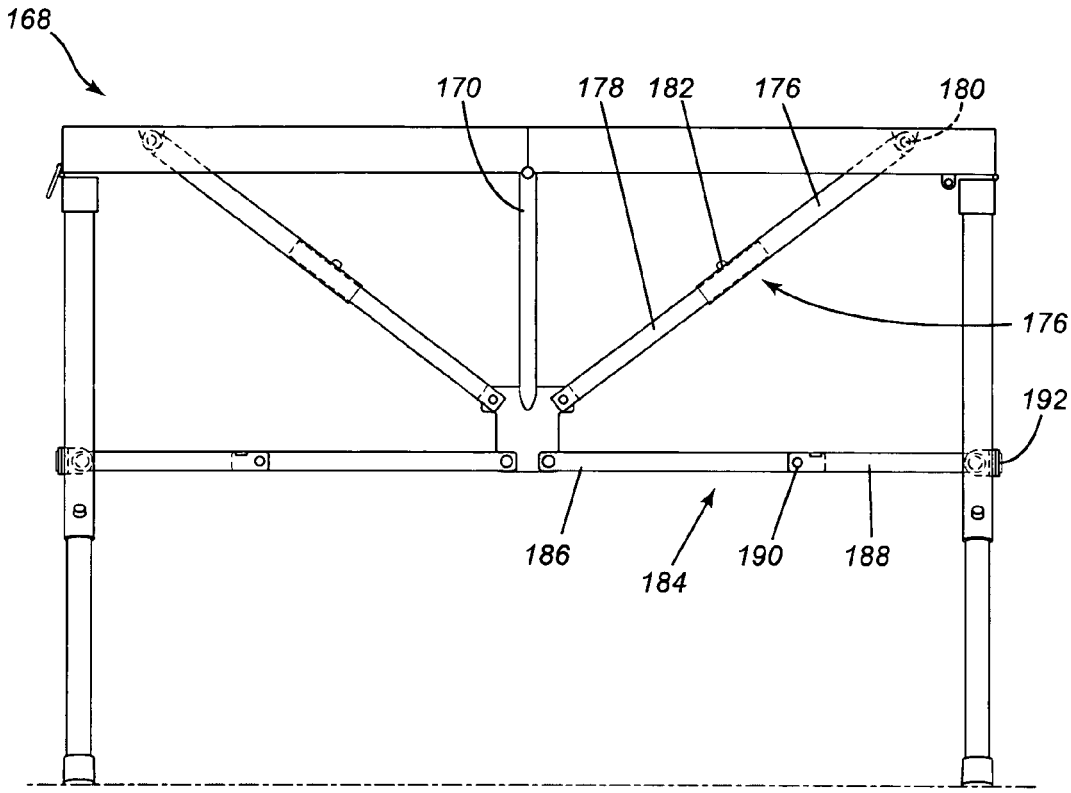
FIG. 13 is a side elevational view of a further embodiment of a sawhorse according to the present invention.
Figure 14:
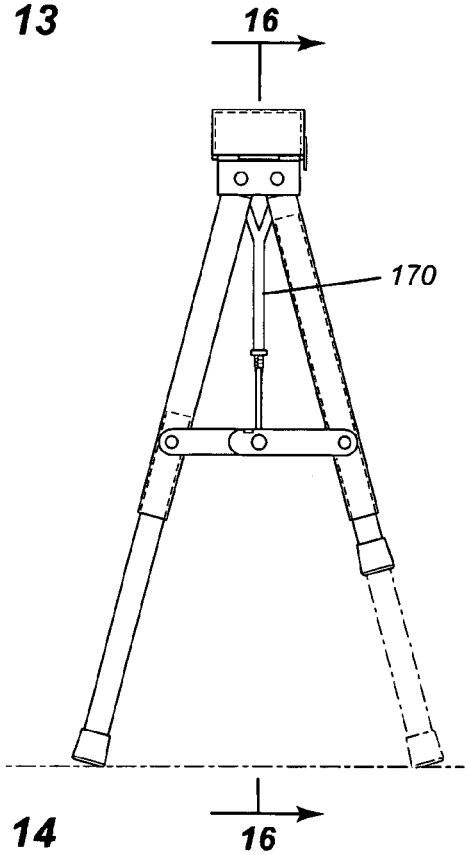
FIG. 14 is an end elevational view thereof.
Figure 15:
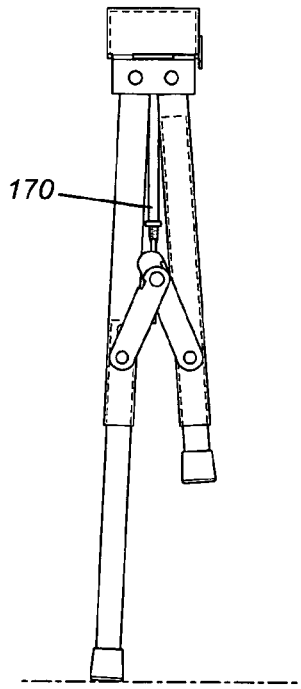
FIG. 15 is an end elevational view thereof in a partially collapsed position.
Figure 16:
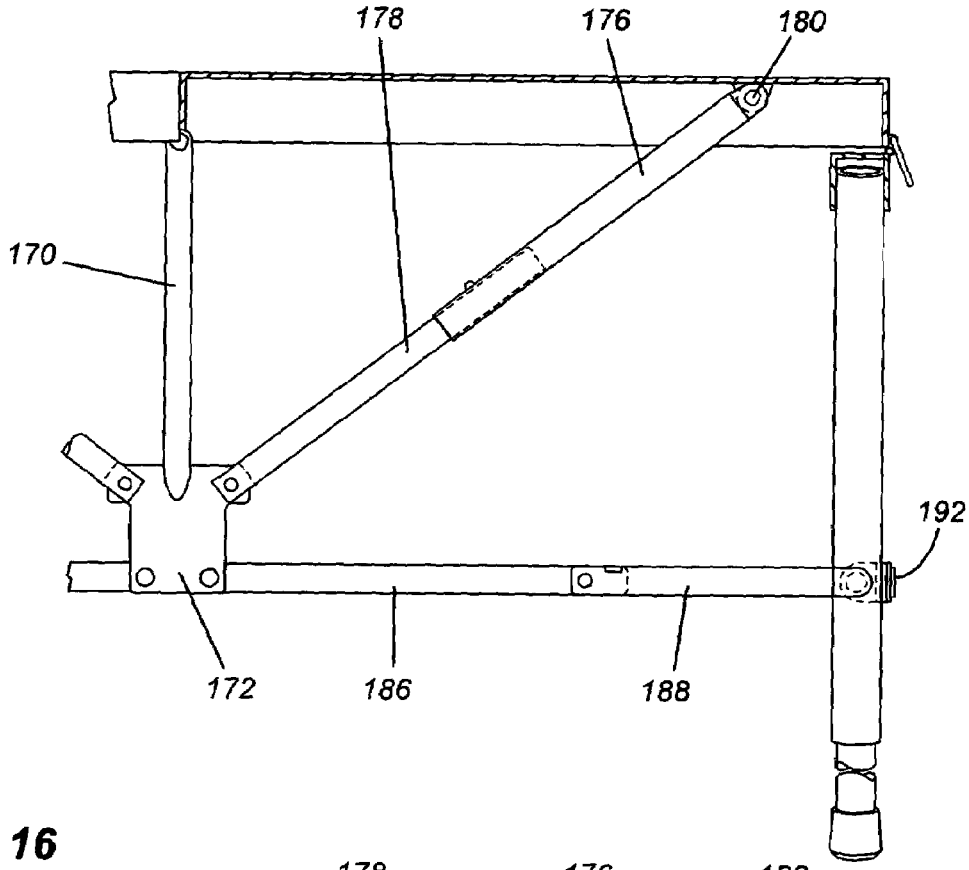
FIG. 16 is a cross sectional view taken along the lines 16—16 of FIG. 14.
Figure 17:
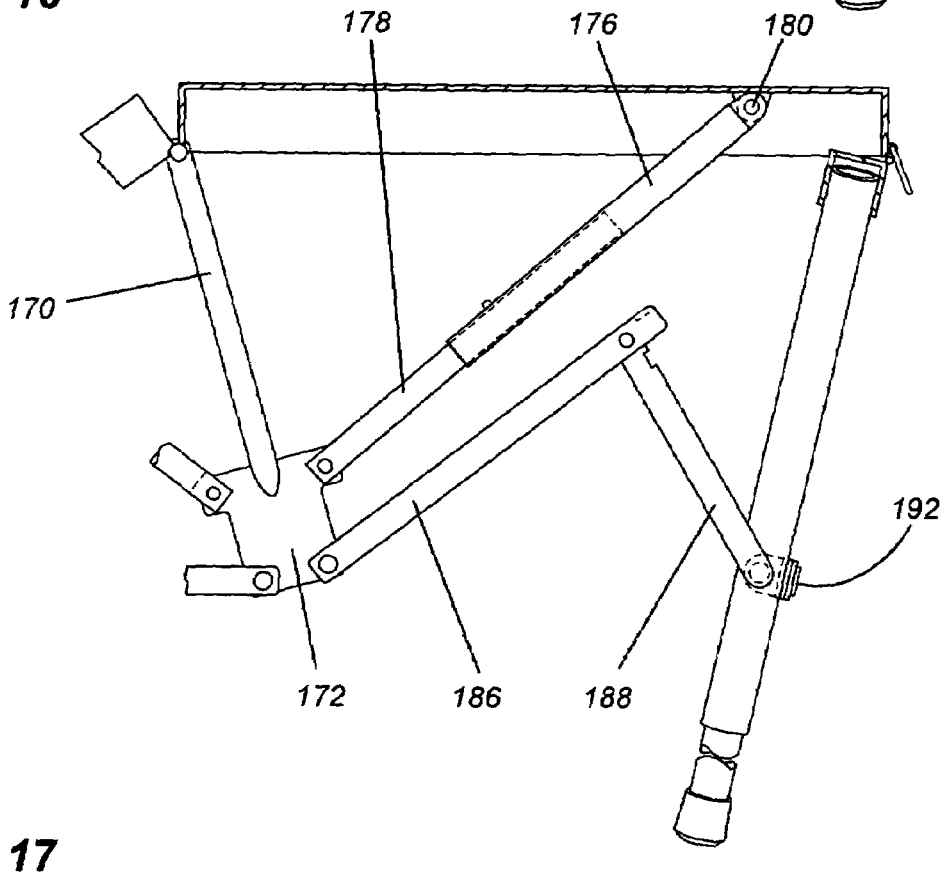
FIG. 17 is a side elevational view of a portion of the sawhorse in a partially collapsed position.

As may be seen in FIG. 9, first leg assembly 116 is comprised of a pair of telescopic sections as described in the previous embodiment. However, hinge member 120 is formed of a single element and is, at one end, hinged to a bracket 122 and at the other end, to a bracket 124, and which bracket 124 is slidably mounted on the leg. Retainer pins 126 for the telescopic legs are provided.

Sawhorse 110 includes a center post 128 and to which is connected, at its lower end, a lower reinforcing assembly 130. Lower reinforcing assembly 130 includes a central portion 132 hingedly connected at hinge point 134 to center post 128. Central portion 132 has, at either end thereof, an extension 136 which is designed to fit within a pair of end portions 138. In turn, end portions 138 include an end section 139 designed to engage within a bracket 140 in a screw threaded manner.

On center post 128, there is provided an eye hook 142. A cable 144 extends between eye hook 142 and bracket 140.

There is also provided a bracket 146 on the inside of right hand beam 114 with a cable 148 extending between bracket 146 and eye hook 142. A tensioning spring 152 is connected between a further eye hook 150 on right hand beam 114 and cable 148. In this respect, spring 152 has an eye 154 formed at one end thereof such that spring 152 may slide along cable 148. Similarly, a spring 156 is connected, at one end, to bracket 146 and at the other end to cable 144. Again spring 156 has an eye 158 formed at one end thereof.

As was the case in the previously described embodiments, sawhorse 110 may be provided with a handle 160 for transport thereof.

In the embodiment of FIGS. 13 to 17, there is illustrated a sawhorse 168 similar to that of sawhorse 110 and thus only the differences will be described herein.

Sawhorse 168 has a center post 170 with a connecting plate 172 located at a distal end thereof. Upper reinforcing assembly generally designated by reference numeral 174 includes a pair of telescopic members 176, 178. Upper member 176 is connected to the beam at upper attachment point 180 with retainer pins 182 functioning to maintain upper member 176 and lower member 178 in a desired position.

A lower reinforcing assembly 184 comprises a first member 186 and a second member 188 hingedly connected at hinge pin 190. First member 186 is connected to connecting plate 172 while second member 188 is connected to bracket 192.

Figure 18:
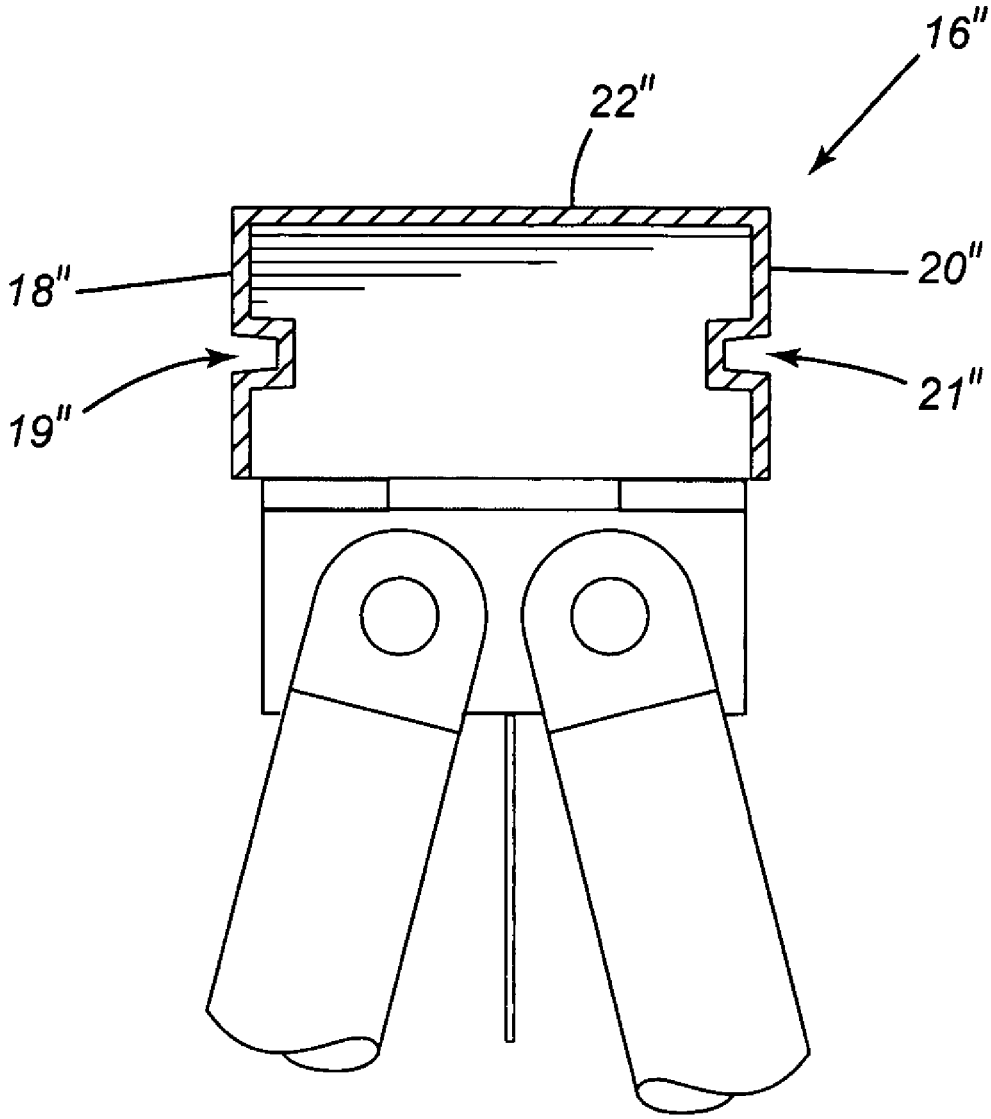
FIG. 18 is a sectional view of a modified beam portion.

As shown in the arrangement of FIG. 18, there is provided a modified beam portion 16" having a first sidewall 18", a second sidewall 28" and an upper wall 22". A groove 19" is provided within sidewall 18" and a groove 21" is provided within sidewall 20". Grooves 19" and 21" may be used to receive a member which will be supported by top wall 22". Thus, a single sawhorse may be utilized to support, for example, a substrate which is secured in position. Such could be useful for supporting certain power tools and the like. Other grooves could also be provided in an extruded beam such as an inverted T shaped recess in upper wall 22".

It will be understood that the above described embodiments are for purposes of illustration only and changes and modifications may be made thereto without departing from the spirit and scope of the invention.

I claim:

1. A portable sawhorse comprising:

a first beam section and a second beam section, said first and second beam sections being pivotally connected together;

a first leg assembly at a distal end of said first beam section and a second leg assembly at a distal end of said second beam section;

each of said first and second leg assemblies having first and second legs extending downwardly, said first and second legs being pivotally connected;

reinforcing means extending between said first and second leg assemblies to stabilize said leg assemblies when in an open position.

2. The portable sawhorse of claim 1 wherein each set of said first and second legs are interconnected by a hinge.

3. The portable sawhorse of claim 2 wherein said reinforcing means includes a rigid member extending between said hinges of said first and second leg assemblies.

4. The portable sawhorse of claim 2 wherein each of said legs are telescopic, said legs having means to lock said legs in an extended position.

5. The portable sawhorse of claim 2 wherein said reinforcing means further includes a post extending downwardly centrally of said first and second beam sections and cables extending between said post and said leg assemblies.

6. The portable sawhorse of claim 2 wherein each of said beam sections has a substantially U-shaped configuration defined by a top wall and sidewalls, said top wall and sidewalls defining a recess therebetween, said recess being designed to receive said leg assemblies when in a retracted position.

7. The portable sawhorse of claim 2 further including a handle secured to one of said beam sections for carrying said sawhorse when in an unassembled condition.

8. The portable sawhorse of claim 5 further including cables extending between said post and the distal ends of said first and second beam sections.

9. The portable sawhorse of claim 8 further including at least one spring member associated with one of said cables for maintaining said cables in a taut condition.

10. The portable sawhorse of claim 1 wherein said reinforcing means comprise a plurality of rigid reinforcing sections.

* * * * *